US007921900B2

(12) United States Patent
Ivanchev et al.

(10) Patent No.: US 7,921,900 B2
(45) Date of Patent: Apr. 12, 2011

(54) PROCESSING OF METAL ALLOYS IN A SEMI-SOLID STATE

(75) Inventors: Hristov Lillian Ivanchev, Germiston (ZA); Daniel Jeremias Wilkins, Pretoria (ZA)

(73) Assignee: CSIR, Brummeria, Pretoria (ZA)

( * ) Notice: Subject to any disclaimer, the term of this patent is extended or adjusted under 35 U.S.C. 154(b) by 0 days.

(21) Appl. No.: 12/820,823

(22) Filed: Jun. 22, 2010

(65) Prior Publication Data

US 2010/0258261 A1 Oct. 14, 2010

Related U.S. Application Data

(62) Division of application No. 10/577,782, filed as application No. PCT/IB2004/052227 on Oct. 28, 2004, now Pat. No. 7,766,071.

(30) Foreign Application Priority Data

Oct. 29, 2003 (ZA) ..... 03/8428

(51) Int. Cl.
*B22D 17/10* (2006.01)

(52) U.S. Cl. ..... 164/113; 164/312; 164/900

(58) Field of Classification Search ..... 164/113, 164/312, 900
See application file for complete search history.

(56) References Cited

U.S. PATENT DOCUMENTS 5,718,280 A * 2/1998 Matsuura et al. ..... 164/498
7,766,071 B2 * 8/2010 Ivanchev et al. ..... 164/113

FOREIGN PATENT DOCUMENTS

JP 2003-251446 A * 9/2003

* cited by examiner

*Primary Examiner* — Kevin P Kerns
(74) *Attorney, Agent, or Firm* — Husch Blackwell LLP

(57) ABSTRACT

A process for forming an article includes locating a container containing a charge of semi-solid metal alloy in a passage in front of a plunger arranged to travel relative to the passage to force the charge of semi-solid metal alloy into a desired shape, and displacing the charge of semi-solid metal alloy from the container and forming it into the desired shape by causing relative travel between the plunger and the passage. The plunger can push a displaceable closure member to displace the closure member and the charge of semi-solid metal alloy along an interior volume of the container from a first opening proximal the plunger and closed by the closure member towards a second opening remote from the first opening.

4 Claims, 3 Drawing Sheets

PROCESSING OF METAL ALLOYS IN A SEMI-SOLID STATE

CROSS-REFERENCE TO RELATED APPLICATIONS

This application is a Divisional of and claims the benefit of the filing date of U.S. application Ser. No. 10/577,782 filed Jan. 3, 2007, now U.S. Pat. No. 7,766,071, which is a national stage filing of and claims the benefit of the filing date of International Application No. PCT/IB2004/052227 filed Oct. 28, 2004, which claims the benefit of the filing date of ZA 2003/8428 filed Oct. 29, 2003.

BACKGROUND OF THE INVENTION

THIS INVENTION relates to the processing of metal alloys in a semi-solid state. In particular, the invention relates to a method of providing a contained charge of semi-solid metal alloy for use in a process for forming an article, to a rheo-casting container for containing a charge of semi-solid metal alloy, to a process for forming an article, and to an injection sleeve or shot sleeve for a die-casting machine.

The processing of metals or metal alloys in a semi-solid state is known as Semi-Solid Metals (SSM) technology. A known SSM processing route is that of thixo-casting. The thixo-casting processing route involves manufacturing billets having a desired microstructure (which is usually supplied to a forming facility by a producer or continuous caster) followed by re-heating to a semi-solid state and forming into the desired product. One of the known advantages of the thixo-casting process is that the forming facility is able to process the semi-liquid metal which readily lends itself to automation of the process. Some of the disadvantages of the thixo-casting process include the difficulty in obtaining fully homogenous billets in a continuous casting (electromagnetic stirred); metal losses during re-heating of the billet; and undesired oxidisation during the re-heating process on the surface of the billet. In addition, gates, runners and risers arising from the formed product cannot usually be re-cycled by the forming facility and must be sent back to the producer/continuous caster, which leads to additional costs.

Thixo-casting, in which the billets are moulded after they are heated to temperatures that produce semi-solid state metals, is different from another known processing route, namely, the rheo-casting processing route. In the rheo-casting processing route, molten metal alloy containing globular or spherical primary crystals is produced and moulded as such without being solidified into billets. In this process the liquid alloy is cooled down to a temperature between the alloy's liquidus and solidus temperature i.e. to provide an alloy in a semi-solid state. This is done in a controlled manner with agitation and, optionally, with the addition of grain refining agents, providing a slurry. The slurry is, subsequently, formed into the desired product. The object of the controlled cooling process and agitation is to avoid or impede dendritic crystallization and, instead, to promote the formation of globular or spherical primary crystals suspended in a liquid eutectic. The desired microstructure is obtained by the combination of controlled cooling, stirring and, optionally, the addition of a grain refining agent.

One of the advantages of the rheo-casting processing route is that the forming facility is able to re-cycle the scrap in-house and there are insignificant metal losses since there is no re-heating. One of the disadvantages with this processing route is that it includes a number of steps and the processes of which the Applicant is aware are thus cumbersome and complex, providing opportunities for optimisation and simplification.

BRIEF SUMMARY OF THE INVENTION

In this specification, any reference to a metal alloy is intended also to include a reference to a metal. Thus, although it is expected that the invention will find particular application in the processing of metal alloys in a semi-solid state, the processing of metals in a semi-solid state is not excluded from the scope of the invention.

According to one aspect of the invention, there is provided a method of providing a contained charge of semi-solid metal alloy for use in a process for forming an article, the method including introducing a charge of molten metal alloy into a container; and allowing the molten metal alloy to reach a semi-solid state, the container including an elongate body defining a side wall of the container, a mouth at a first end of the body and an opening at a second end of the body remote from the mouth; and a closure member closing the opening, the closure member being configured to be displaceable along an interior volume of the body from the second end towards the first end to displace the charge of semi-solid metal alloy and the closure member being of a metal alloy the same as or similar to the charge of metal alloy and having a melting point which is not less than the temperature of the molten metal alloy introduced into the container.

Typically, the closure member is dimensioned to be displaceable through the mouth of the container.

The metal alloy of the closure member must thus be of the same or of similar chemical composition as the charge of molten metal alloy to allow the closure member to be remelted with runners, gates and risers and other scrap metal or the like produced by the product forming process to provide a further charge or charges of molten metal alloy for use in the product forming process, without substantial adjustment of the molten metal alloy composition being required.

Allowing the molten metal alloy to reach a semi-solid state may include simultaneously subjecting the charge of molten metal alloy to controlled cooling and induced turbulent agitation or flow, e.g. induction induced turbulent flow.

The invention extends to a process for forming an article, the process including providing a contained charge of semi-solid metal alloy in accordance with the method hereinbefore described; and displacing the charge of semi-solid metal from the container and forming the charge into a desired shape.

The process for forming an article may be a rheo-casting process.

Displacing the charge of semi-solid metal from the container typically includes displacing the closure member out of the elongate body, through the mouth.

According to another aspect of the invention, there is provided a rheo-casting container for containing a charge of semi-solid metal alloy, the container including an elongate body defining a side wall of the container, a mouth at a first end of the body, and an opening at a second end of the body remote from the mouth; and a closure member to close the opening, the closure member being configured to be displaceable along an interior volume of the body from the second end towards the first end to displace a charge of semi-solid metal alloy contained in the container and the closure member being of a metal alloy the same as or similar to the semi-solid metal alloy for which the container is to be used and having a melting point which is not less than the temperature at which the metal alloy is to be introduced into the container.

The melting point of the metal alloy of the closure member, if different from the semi-solid metal alloy for which the container is to be used, may be between 1° C. and 50° C., more preferably between 5° C. and 25° C., higher than the liquidus temperature of the metal alloy introduced or to be introduced into the container, the metal alloy typically being introduced into the container in a molten state.

It is expected that the method and container of the invention will find application in rheo-casting processes involving a variety of metals and metal alloys. Thus, examples of the metal or metal alloy of the closure member include aluminium and aluminium alloys, zinc and zinc alloys, copper and copper alloys, brass and magnesium alloys.

The side wall of the container may define a cylindrical interior surface for the container. In one embodiment of the invention, which is expected to be a preferred embodiment, the side wall defines a circular cylindrical interior surface, with the closure member being disc-shaped.

The body may define a seat, e.g. a radially inwardly projecting rim or flange to support the closure member in the opening thereby to allow the closure member to close the opening. Instead, in a preferred embodiment, the closure member is located or locatable with a friction fit inside the body to close the opening, whilst still being displaceable along the interior volume of the body.

The body may be of a stainless steel.

According to a further aspect of the invention, there is provided a process for forming an article, the process including locating a container containing a charge of semi-solid metal alloy in a passage in front of a plunger or piston arranged to travel relative to the passage to force the charge of semi-solid metal alloy into a desired shape; and displacing the charge of semi-solid metal alloy from the container and forming it into the desired shape by causing relative travel between the plunger and the passage.

The process for forming the article may be a rheo-casting process.

The passage may be defined by an injection sleeve or a shot sleeve of die-casting apparatus and the charge of semi-solid metal alloy may thus be formed by forcing it into a die by means of the plunger or piston.

The process may include providing the container containing the charge of semi-solid metal alloy in accordance with the method for providing a container containing a charge of semi-solid metal alloy as hereinbefore described.

Typically, the charge is displaced from the container and formed into the desired shape by a single continuous stroke of the plunger.

The container may be open-ended and may include a displaceable closure member closing one opening and configured to be displaceable along an interior volume of the container from the one open end closed by the closure member towards the other open end. Displacing the charge of semi-solid metal alloy may thus include pushing with the plunger against the closure member to displace the closure member and the charge of semi-solid metal alloy from the container.

The container may be a container as hereinbefore described.

The process may include leaving the closure member to form part of a solidified runner of an article formed by the process, and in particular to form part of the so-called solidified biscuit of an article formed by die-casting.

The process may further include separating the runner from the cast article, treating the runner, including the closure member, optionally together with further metal alloy, to provide a further container containing a charge of semi-solid metal alloy, and locating the container in the passage in front of the plunger, in order to form a further article. Thus, the process may include recycling the closure member, together with the runner or runners and other scrap metal alloy produced during the process, to form or cast further articles.

The process may include releasably or temporarily securing the container in front of the plunger.

The process may include retracting the plunger from the container, and removing the empty container, after having formed the charge of semi-solid metal alloy into the desired shape.

According to yet a further aspect of the invention, there is provided an injection sleeve or shot sleeve for a die-casting machine, the sleeve defining a plunger passage and including a container supporting portion to support a container containing a charge of semi-solid metal alloy with the charge being axially aligned with the plunger passage.

The container supporting portion may include a cradle to support said container, the cradle being shaped to support a container too large to fit into the plunger passage.

In one embodiment of the invention, the plunger passage has a circular cylindrical interior surface and the container supporting portion is configured to support a container having a circular cylindrical interior with an interior diameter the same or only marginally smaller than the interior diameter of the plunger passage, the container supporting portion making provision for the wall thickness of the container so that the plunger passage and the container are axially aligned.

The sleeve may include an ejector to eject said container from the container supporting portion. The ejector may be mechanically, electrically, pneumatically or hydraulically operated.

The sleeve may include retaining means to retain the container in or on the container supporting portion during operation of the sleeve.

The invention extends to a die-casting machine which includes an injection sleeve or shot sleeve as hereinbefore described.

The die-casting machine may be a high pressure die-casting machine.

BRIEF DESCRIPTION OF THE DRAWINGS

The invention will now be described, by way of example, with reference to the accompanying diagrammatic drawings in which.

DETAILED DESCRIPTION OF THE INVENTION

Figure 1:
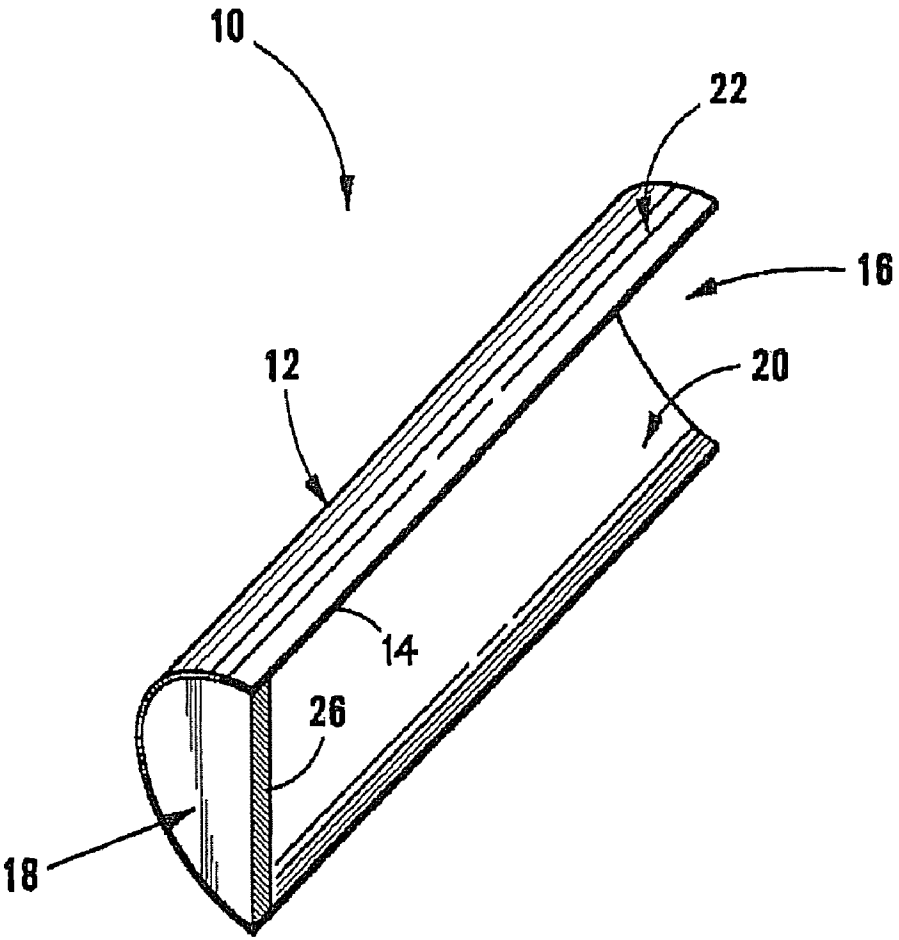
FIG. 1 shows a longitudinally sectioned three-dimensional view of a container in accordance with the invention for containing a charge of semi-solid metal alloy.

Referring to FIG. 1 of the drawings, reference numeral 10 generally indicates a container or crucible in accordance with the invention for containing a charge of semi-solid metal alloy. The container 10 is intended for use with molten aluminium alloy A356. The container 10 includes an elongate body 12 defining a side wall 14 of the container 10. A mouth 16 is defined at a first end of the body 12 and an opening 18 is defined at a second end of the body 12, remote from the mouth 16.

The body 12 is of stainless steel A316. The body 12 is circular cylindrical or tube-like, so that both an interior surface 20 and an exterior surface 22 of the side wall 14 are circular cylindrical.

A disc-shaped closure member 26 is provided inside the body 12 to close the opening 18. The closure member 26 fits snugly inside the body 12 and is of aluminium alloy A356. Tolerances between the closure member 26 and the surface 20 of the container 10 are thus small enough to ensure that molten metal alloy does not leak past the closure member 26, allowing the closure member 26 frictionally to be located in the opening 18, whilst at the same time allowing easy relative axial displacement between the closure member 26 and the side wall 14.

In use, the closure member 26 is inserted into the body 12 to be frictionally located inside the body 12, thereby closing the opening 18. A batch of aluminium alloy A356 is melted in a melting furnace and then the molten metal alloy is transferred into a holding furnace. After the composition and temperature of the alloy have been checked and adjusted, if necessary, the molten metal alloy is poured at a temperature of 630° C. into the container 10. On contacting the molten aluminium alloy, the aluminium alloy closure member 26 is heated and expands more than the stainless steel body 12. The closure member 26 is however thick enough not to melt. This ensures that the closure member 26 remains intact and seals the opening 18, preventing molten metal alloy from running out through the opening 18.

After the molten metal alloy has been poured into the container 10, the container 10 is transferred to a slurry maker, such as the slurry maker described in WO 2004/070068 A1, for treatment to allow the metal alloy A356 to reach a semi-solid state. The semi-solid metal alloy A356 can then be used in a rheo-casting method or another forming method to produce or form an article or object.

Figure 2:
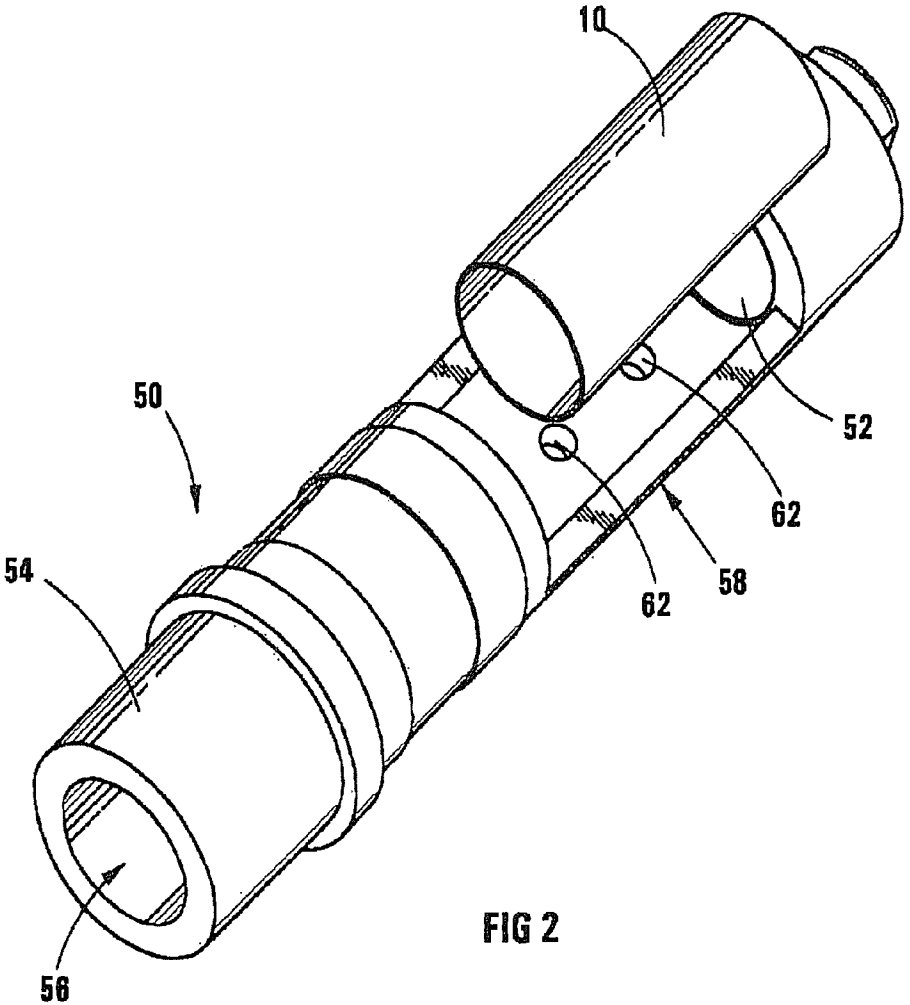
FIG. 2 shows a three-dimensional view of the container of FIG. 1, being located in an injection sleeve or shot sleeve in accordance with the invention, forming part of a die-casting machine.
Figure 3:
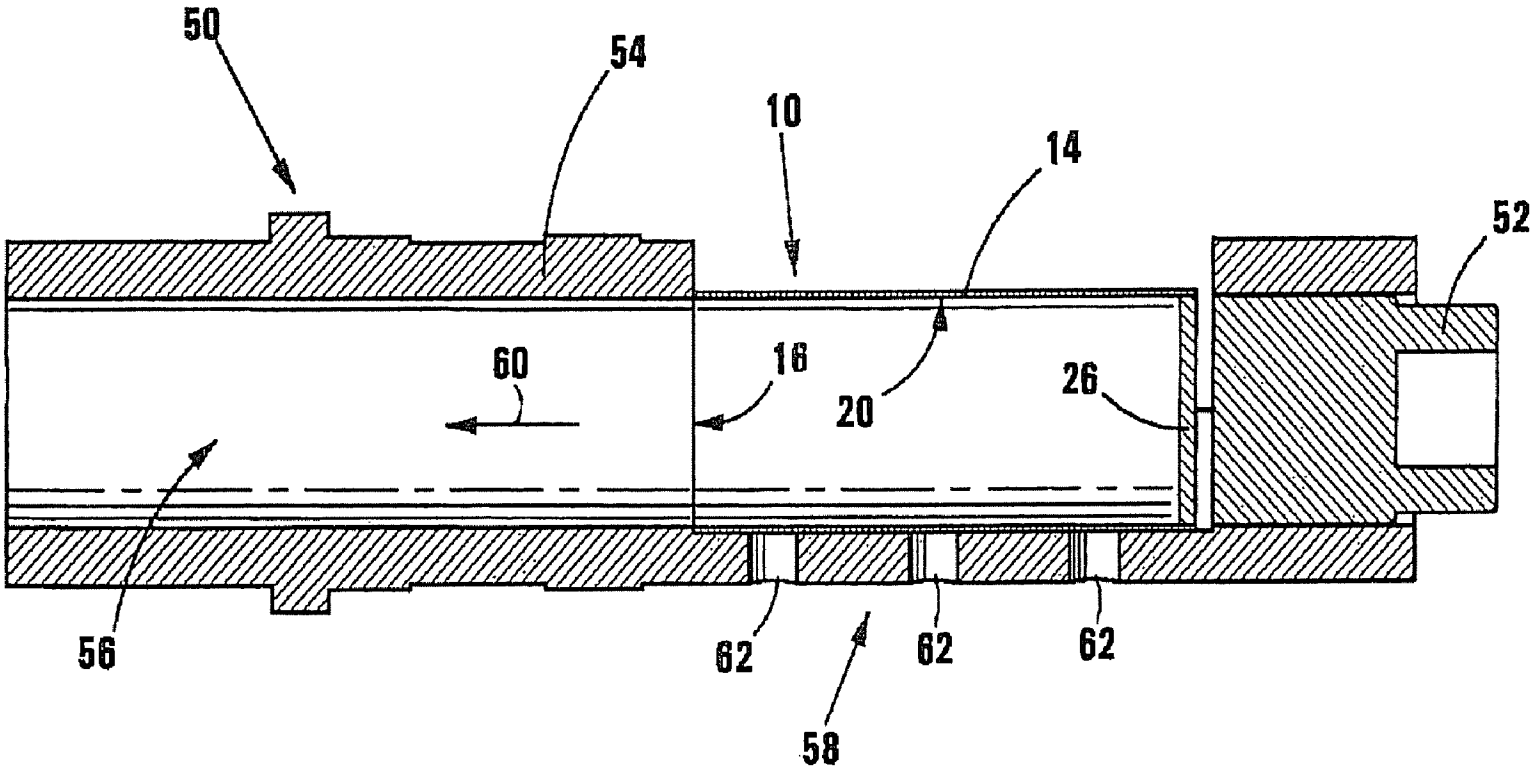
FIG. 3 shows a longitudinally sectioned side view of the shot sleeve and container of FIG. 2, with the container being supported by the shot sleeve.

Referring to FIGS. 2 and 3 of the drawings, reference numeral 50 generally indicates an injection sleeve or shot sleeve of a die-casting machine. Also shown in FIGS. 2 and 3, is a piston or plunger 52 operatively associated with the shot sleeve 50. The remainder of the die-casting machine is not shown, as it is conventional and well known to those skilled in the art of die-casting.

The shot sleeve 50 includes a steel tube 54 defining a plunger passage 56, which is circular cylindrical. The piston or plunger 52 is arranged to travel backwards and forwards along the plunger passage 56 and fits snugly inside the plunger passage 56.

The shot sleeve 50 further includes a container supporting portion 58 to support the container 10 containing a charge of semi-solid metal alloy. In the embodiment of the invention shown in FIGS. 2 and 3, the container supporting portion is in the form of, or includes a cradle to support the container 10.

As can be clearly seen in FIG. 3 of the drawings, the container 10 is slightly larger than the plunger passage 56 and can therefore not fit into the plunger passage 56. The container supporting portion 58 is dimensioned to support the container 10, taking into account the wall thickness of the side wall 14 so that the interior surface 20 of the container 10 is exactly aligned with an interior surface of the plunger passage 56, effectively forming an extension of the plunger passage 56. In other words, the plunger passage 56 and the container 10 are perfectly in register and are also axially aligned with the plunger 52.

If required, the shot sleeve 50 can be provided with a retaining mechanism or device (not shown) to retain the container 10 in the cradle. This retaining mechanism may be as simple as a clamp.

In order to displace a charge of semi-solid metal alloy from the container 10 through the plunger passage 56, the plunger 52 is activated (typically hydraulically) and moves forward in the direction of arrow 60 to push against the closure member 26. As can be noted in FIG. 3, the plunger 52 is dimensioned to pass through the opening 18 in the container 10 so that it can bear against a full face of the closure member 26. Further forward travel of the plunger 52 then displaces the closure member 26, and the charge of semi-solid metal alloy in the container 10, through the interior volume of the container 10 and into the plunger passage 56. Forward movement of the container 10 is prevented by the side wall 14 bearing against the steel tube 54.

The plunger passage 56 opens out into a die (not shown), which is typically a split die. As the plunger 52 continues to travel forwardly through the plunger passage 56 in the direction of arrow 60, the closure member 26 and charge of semi-solid metal alloy is forced into the die to be formed into a cast object or article of desired shape.

Typically, in a conventional die-casting process, a runner of solidified metal alloy is formed inside the split die, between a leading surface of the plunger and the object of desired shape. According to the invention, the closure member 26 is allowed to form part of this solidified runner. More particularly, the closure member 26 is allowed to form part of the biscuit of the runner, which is the portion of the runner immediately ahead of the plunger 52.

In order to remove the empty container 10 from the container supporting portion 58, the plunger 52 is retracted to the position shown in FIG. 3 and an ejector (not shown) is activated. If necessary, the retaining mechanism is first released. The ejector can act on the container 10 via three apertures 62 in the container supporting portion 58. However, it is to be appreciated that such an ejector may be mechanically, electrically, pneumatically or hydraulically operated and in fact may consist merely of a controlled supply of compressed air which can be pulsed through the apertures 62 to eject the container 10 from the container supporting portion 58.

After ejection, the container 10 is cleaned and fitted with a new consumable closure member 26 for reuse. Preferably, prior to use, the interior of the container 10 is coated or sprayed with a release agent, such as a boron nitride solution.

Advantageously, as the runner of the object formed or cast includes the closure member 26 which is of a composition the same as or similar to the composition of the runner, the runner can easily be recycled, with the closure member 26, for further casting or forming of objects. In other words, advantageously, it is not necessary to separate the closure member 26 from the runner before the runner is recycled, as the runner and closure member 26 can be recycled without unusual or substantive adjustment of the chemical composition of the recycled alloy being required. A further advantage of the invention, as illustrated, is that the plunger 52 does not have to come into direct contact with the semi-solid metal alloy, allowing the plunger 52 to be manufactured of less exotic or less expensive materials.

The invention claimed is:

1. A process for forming an article, the process including locating a container containing a charge of semi-solid metal alloy in a passage in front of a plunger or piston arranged to travel relative to the passage to force the charge of semi-solid metal alloy into a desired shape, the container having a first opening proximal the plunger and a second opening remote from the first opening and including a displaceable closure member closing said first opening, the displaceable closure member being configured to be displaceable along an interior volume of the container from the first opening closed by the closure member towards the second opening; and displacing the charge of semi-solid metal alloy from the container and aiming it into the desired shape by causing relative travel between the plunger and the passage, displacing the charge of semi-solid metal alloy including pushing the closure member with the plunger to displace the closure member and the charge of semi-solid metal alloy along the interior volume of the container from the first opening to the second opening and out through the second opening of the container.

2. The process as claimed in claim 1, which includes leaving the closure member to form part of a solidified runner of a cast article formed by the process.

3. The process as claimed in claim 2, which includes separating the runner from the cast article, treating the runner, including the closure member, optionally together with further metal alloy, to provide a further container containing a charge of semi-solid metal alloy, and locating the container in the passage in front of the plunger, in order to form a further article.

4. The process as claimed in claim 1, in which a side wall of the container extends unbroken or continuously between the first opening and the second opening and in which the first opening and the second opening face each other.

* * * * *